United States Patent [19]

Marder

[11] Patent Number: 4,588,237

[45] Date of Patent: May 13, 1986

[54] APPARATUS AND METHOD FOR DISPENSING MEDICINE

[76] Inventor: Herbert B. Marder, 177 Lakewood Place, Highland Park, Ill. 60035

[21] Appl. No.: 576,441

[22] Filed: Feb. 2, 1984

[51] Int. Cl.[4] ..... B01L 9/02

[52] U.S. Cl. ..... 312/209; 312/183; 312/308; 312/330 R

[58] Field of Search ..... 312/209, 234.1, 234.4, 312/234.5, 308, 330 R, 183, 250, 126, 119, DIG. 33; 211/59.2

[56] References Cited

U.S. PATENT DOCUMENTS

| | | | |
|---|---|---|---|
| 59,086 | 10/1866 | Skinner | 312/209 |
| 1,272,149 | 7/1918 | Thompson | 40/490 X |
| 1,435,351 | 11/1922 | Wagemaker | 312/308 |
| 1,524,748 | 2/1925 | O'Connor | 211/59.2 |
| 1,993,477 | 3/1935 | Gourley et al. | 312/308 X |
| 2,022,591 | 11/1935 | Everitt | 312/250 X |
| 2,239,618 | 4/1941 | Muirhead | 312/119 X |
| 2,255,744 | 9/1941 | Loeb et al. | 312/234 |
| 2,413,164 | 12/1946 | Boldt et al. | 312/250 X |
| 2,425,232 | 8/1947 | Earle | 312/330 R X |
| 2,490,588 | 12/1949 | Frie et al. | 312/250 X |
| 2,530,220 | 11/1950 | Belcher | 312/209 X |
| 2,575,661 | 11/1951 | Hickey | 312/209 X |
| 2,711,944 | 6/1955 | Meek et al. | 312/308 X |
| 3,355,231 | 11/1967 | Kegel | 312/308 X |
| 3,442,378 | 5/1969 | Wolfe | 211/74 |
| 3,520,583 | 7/1970 | Case | 312/250 X |
| 3,715,148 | 2/1973 | Beals | 312/250 X |
| 3,768,710 | 10/1973 | Eggers | 211/71 X |
| 3,817,588 | 6/1974 | Helmers | 312/234.1 X |
| 3,834,778 | 9/1974 | Morrison et al. | 312/209 |
| 3,876,268 | 4/1975 | Colver | 312/234.5 X |
| 4,019,793 | 4/1977 | Gerding | 312/250 X |
| 4,054,343 | 10/1977 | Heyland | 312/234.1 |
| 4,114,965 | 9/1978 | Oye et al. | 312/209 |
| 4,127,311 | 11/1978 | Weiman | 312/234.3 X |
| 4,349,338 | 9/1982 | Heppler | 312/209 X |

FOREIGN PATENT DOCUMENTS

| | | | |
|---|---|---|---|
| 968761 | 4/1972 | Canada | 211/71 |
| 81829 | 6/1983 | European Pat. Off. | 312/209 |
| 829656 | 7/1949 | Fed. Rep. of Germany | 312/183 |
| 1035331 | 7/1958 | Fed. Rep. of Germany | 312/234.1 |
| 1152793 | 8/1963 | Fed. Rep. of Germany | 312/183 |
| 3013866 | 10/1981 | Fed. Rep. of Germany | 312/119 |
| 62120 | 6/1951 | France | 312/234.5 |
| 1384034 | 11/1964 | France | 312/234.1 |

*Primary Examiner*—William E. Lyddane
*Assistant Examiner*—Thomas A. Rendos
*Attorney, Agent, or Firm*—Trexler, Bushnell & Wolters, Ltd.

[57] ABSTRACT

A cart on casters is provided for dispensing medication to patients as in a nursing home. The cart is provided with a plurality of drawers, each of which is divided into a plurality of storage areas or compartments. Slide members are mounted on top of the partitions, and are provided with recesses for holding medicine cups and with cross slots for holding patient identification cards. Patient medication cards and blister pack medication cards are stored in an adjacent storage area or compartment in the same order as and in close contiguous relation with the cups and patient cards. Each slide member can be pulled forwardly of its respective drawer for more ready access for dispensing of medication from the cups. An additional dispensing area is provided for medicines that are dispensed as needed including pivotable plastic cups which are turned as soon as the medication has been dispensed so that it is apparent that dispensing has taken place.

4 Claims, 5 Drawing Figures

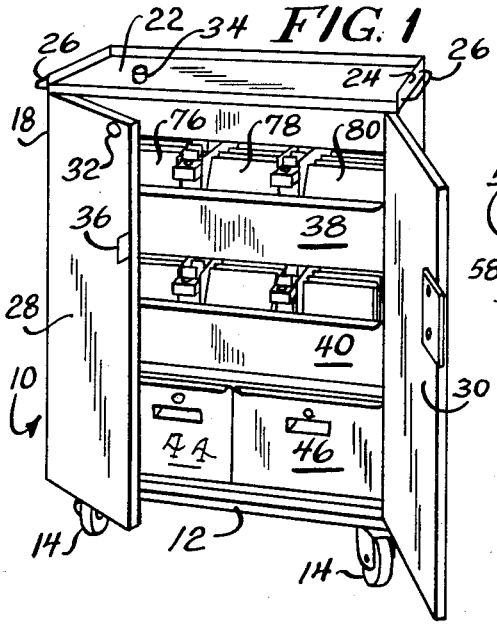
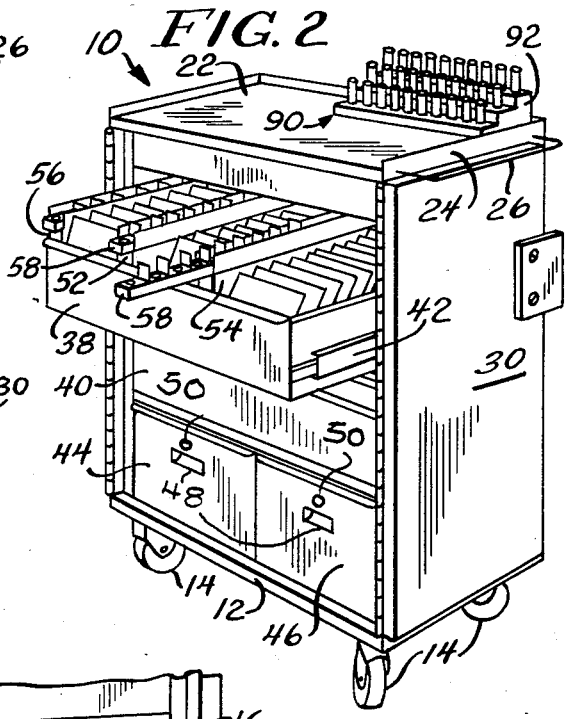
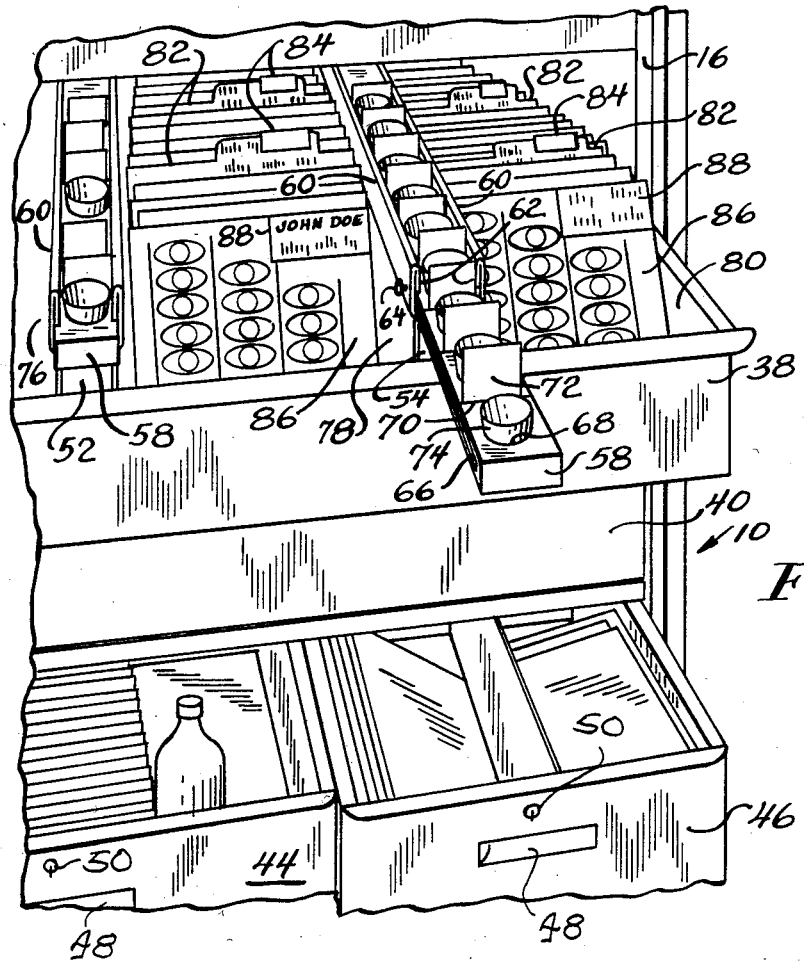
FIG. 3

FIG. 4
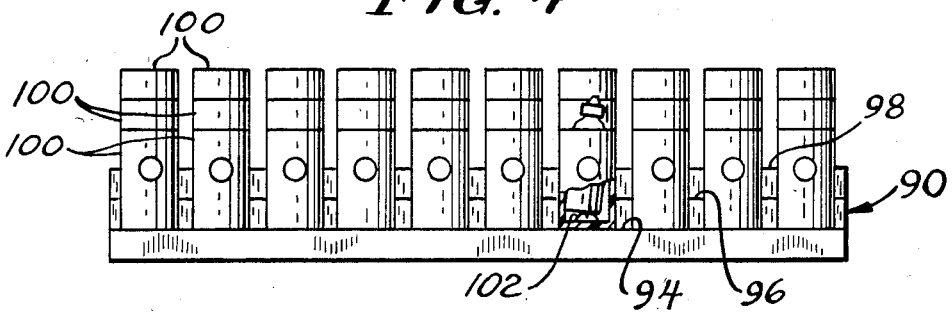
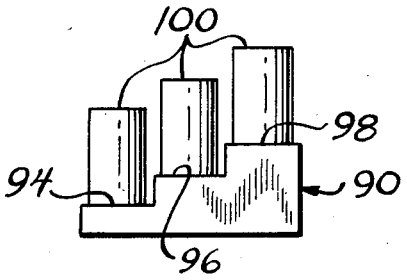
FIG. 5

APPARATUS AND METHOD FOR DISPENSING MEDICINE

RELATED APPLICATION

The present application is related to and forms an improvement over my co-pending application Ser. No. 493,931, filed May 12, 1983 for "Apparatus and Method for Dispensing Medicine".

BACKGROUND OF THE INVENTION

The dispensing of medicine to large numbers of patients as in a hospital or nursing home presents many problems. It is often necessary to move medicines from a supply location to wherever the patients may be at a given time. In a hospital a patient is most usually found in his room, but nursing homes provide far greater problems as patients may be in a recreation area, or a lunch room, or otherwise in a location where many patients are present at the same time. Patients in nursing homes often are confused or forgetful, and a patient may simply wander away before a nurse can deliver to him all of his medicine and be sure that he takes it. Conversely, a confused patient may forget that he has already had his medicine, and try to help himself thereto. Constant attention is demanded on the part of the nurse dispensing medication to be sure that patients do not take medicine that they are not supposed to, and that patients actually take the medicine that they are supposed to. This also leads to more time expended in dispensing of medicines than can be afforded, and leaves opportunities for possible errors in the dispensing of medicine.

In my aforesaid co-pending application, Ser. No. 493,931, I disclose a medicine dispensing cart in which patient cards and medication cards were stored in bins comprising spacer walls on shelves arranged fore and aft of the cart with cup holders disposed in front of each bin for dispensing of individual medications. The medication cart and the attendant method of operation thereof worked quite well, but required considerable cart height, and was of slightly limited storage capacity for the size of the cart.

OBJECTS AND SUMMARY OF THE PRESENT INVENTION

It is an object of the present invention to provide a mobile medicine cart from which medicines may be quickly dispensed as in a nursing home, patient and medication cards being stored in drawers with individual patient dispensing cups located respectively adjacent such cards.

A further object of the present invention is to provide a medication cart as set forth in the preceeding object in which the medication dispensing cups are mounted on slide members on the respective drawers, which slide members are respectively slidably forward from the drawers for ready access to the cups.

In attaining the foregoing and other objects I provide a mobile cart having casters thereon facilitating rapid movement from a storage location to one or more medicine dispensing locations. The cart is provided with a plurality of drawers, each of which is provided with fore and aft partitions dividing the drawers into card storage areas. For each patient there is a patient identification card and one or more blister pack cards carrying medications, the patient card and medication cards being stored on edge in contacting relation in one of the card storage areas. Slide members are disposed on top of the partitions and are each provided with a plurality of recesses for storing cups and adjacent slots for holding cards with patient's names. The cups and cards are normally disposed adjacent the respective patient cards so that medications can be pre-arranged in the dispensing cups. The slide members are then slidable forwardly for more ready access by a nurse who dispenses the medicines to the patients.

THE DRAWINGS

The present invention will best be understood with reference to the following specification when taken in connection with the accompanying drawings wherein:

FIG. 1 is a perspective view of a medication cart constructed in accordance with the present invention;

FIG. 2 is a perspective view of the medication cart showing certain of the parts in different positions;

FIG. 3 is a further perspective view showing certain parts in different positions;

FIG. 4 is a front view of a rack on top of the cart for certain types of medications; and FIG. 5 is a view at right angles to FIG. 4.

DETAILED DISCLOSURE OF THE ILLUSTRATIVE EMBODIMENT

Referring now in greater detail to the drawings, and first to FIGS. 1–3 there is shown a cart 10 constructed in accordance with the principles of the present invention. The cart is of generally upright rectangular configuration and has a bottom wall or floor 12 having four casters 14 secured to the underside thereof and adjacent the corners. The cart further includes a pair of sidewalls 16 and 18 upstanding from the floor 12 and joined by a rear wall (not shown). A top wall 22 is joined to the rear wall and to the side walls 16 and 18 adjacent the upper limits thereof. The cart is constructed mostly of wood, but an upstanding metal flange 24 extends around the sides and back to retain loose articles on the top wall 22. Towel bars 26 are secured to the top portions of the sidewalls adjacent to the flange 26.

Doors 28 and 30 are hinged to the front edges of the side walls and are foldable back against the sidewalls to which they are secured as by patches of Velcro 32. The doors close across the front of the cart, with a portion of the free edge of the door 28 closing against a portion of the confronting edge of the door 30 so that the door 30 cannot be opened until after the door 28 is opened. A key lock mechanism 34 is provided in the top wall adjacent the front edge thereof for locking the door 28 in closed position. The doors are provided adjacent their free edges with handles 36 for manually opening the doors with the lock mechanism 34 in unlocked position.

The cart is provided with a pair of full width drawers, respectively an upper drawer 38 and a lower drawer 40, mounted on suitable pull-out drawer-slide mechanisms 42. Each of the drawers 38, 40 is only about $\frac{2}{3}$ of the height of the space in which it is mounted. Beneath the lower drawer 40 there is a pair of half-width drawers or bins 44 and 46 occupying substantially the entire height of the space available. The drawers 44 and 46 are provided with front handles 48 for opening of the drawers, and these drawers preferably also are provided with independent locks 50. The drawers 44 and 46 are utilized primarily for storage of "as needed" medications which are provided for patients in accordance with the patient's needs, and not on any particular time schedule.

Such medications may be in bottles or jars, or in blister pack cards.

Each of the drawers 38, 40 is divided into three storage areas or compartments by a pair of walls 52 and 54 extending from front to back of the respective drawer and approximately equally spaced from each other and from the end walls of the drawers transversely of the drawers. A third, similar upstanding wall 56 is provided immediately adjacent to and inside of the left end wall of each respective drawer. Each of the walls 52, 54 and 56 is surmounted by a slide member 58 slidingly disposed between upstanding metal walls 60 secured to either side of each of the walls 52, 54 and 56, the latter preferably being of wood or a wood product such as chip board. Each of the metal walls 60 has a downwardly turned, re-entrant flange 62 at the upper edge thereof and overlying the respective wall 52, 54, 56 to prevent the respective slide member 58 from moving upwardly. Each slide member 58 is movable forwardly from a position overlying the respective drawer to a position extending outwardly from the drawer as shown in FIGS. 2 and 3 for example. Forward movement of each slide member is limited by a screw 64 threaded through one of the adjacent walls 60 and extending into a longitudinal slot 66 in the side of the slide member.

Each slide member 58 is elongated, and is of sufficient width, say on the order of an inch and one-half to two inches, to accommodate a plurality of circular holes or recesses 68 spaced from front to rear thereof. Each recess 68 is designed to receive a pleated paper cup 74 of the type sometimes referred to as a souffle cup for receipt of an individual patient's medicines. Immediately to the rear of each recess 68 there is a transverse slot 70 for receipt of an upstanding patient name card 72.

Each drawer 38, 40 is divided by the respective walls 52 and 54 into three equal storage areas or compartments 76, 78 and 80. A plurality of conventional patient cards 82 is disposed in the respective storage areas or compartments and has a raised tab thereon for receipt of an adhesive label bearing the patient's name. As in my aforesaid co-pending application Ser. No. 493,931, the patient's name preferably appears twice on each tab, and a slidable plastic member 84 exposes words either "NOT PASSED" OR "PASSED", to indicate whether the patient has had his medicine passed to him or not. All of the given patient's blister pack cards 86 of medications are disposed immediately forward of the respective patient cards. A prescription card 88 is secured to the upper right corner of the medication card 86 as by adhesive or by stapling, this card giving the patient's name and prescription as well as the doctor's name, prescription number and date.

Each slide member 58 has nine recesses in it plus nine slots with patient cards. Thus, each storage area or compartment 76, 78 or 80 to the right of a given slide member is provided with nine patient cards and the corresponding medication cards for those respective nine patients, with the patient cards and medications arranged in a logical order, such as alphabetically, or possibly by room number. When it is time for medications to be passed out, the nurse checks each patient card and the medications associated therewith, and places the requisite medications in the cup 74 for that patient. This can be done in a quiet room or otherwise in a secluded area away from patients. The cart then is wheeled to a dispensing area, and one particular slide is pulled out, and the medications in the respective cups are dispensed to the respective patients. That particular slide is then returned to rest position, and a subsequent slide is pulled out, and the medications dispensed etc. This can all be done at a single site, or at a plurality of sites, as may be necessary or convenient. It will be clear that each patient cup is identified by name and is oriented by position adjacent to a given patient card and the corresponding medication cards.

A further aspect of the present invention is illustrated particularly in FIGS. 4 and 5, and comprises a "PRN" medication dispenser 90. "PRN" medications are those which are dispensed to the patient when needed, and are not dispensed when they are not needed. The PRN medication dispenser 90 comprises a base 92 which is rectangular in outline, and which is provided with three steps or shelves 94, 96 and 98, extending in the long direction of the base 92, transversely of the cart 10. Ten clear plastic cups 100 are mounted across each shelf and are secured in place respectively by screws 102 which allow turning or pivoting of the cups. Each cup is assigned to a particular patient, and arranged in orderly fashion by means such as alphabetical order or by room number, and a relevant PRN medication such as eye drops is placed in its own container within the respective cup 100. A colored dot of adhesively applied sheet material is secured to the front of each cup 100 to indicate the time or times of day at which the PRN medication may be supplied to the patient. The container of medication, such as eyedrops, is disposed in the cup with the front label thereof showing so that the nurse readily can tell exactly what the medication is. As soon as the medication is dispensed to a patient at a given time, the respective cup 100 is turned 180 degrees so that both the colored dot on the cup and the label on the medication face to the rear and cannot be read by the nurse, whereby it can be told at a glance that the medication has already been dispensed.

It will now be apparent that I have disclosed an improved medicine cart and an improved method for dispensing medications therefrom which allows a nurse dispensing medicines to patients to spend a minimum amount of time at the dispensing site, thereby minimizing the opportunnity for patients to wander away, without having obtained medication, or for a confused patient, thinking he has not yet had his medication taking additional medication. The nurse's attention can be directed almost entirely to the cart, whereby the nurse is less readily distracted by patients than with any other system of dispensing medication. The apparatus and method are similar to that in my previously identified application Ser. No. 493,931, but are somewhat more convenient in operation.

The specific example of the invention as herein shown and described is for illustrative purposes only. Various changes in structure will no doubt occur to those skilled in the art and will be understood as forming a part of the present invention insofar as they fall within the spirit and scope of the appended claims.

The invention is claimed as follows:

1. A cart for use in dispensing medications to a plurality of patients comprising a base, wheel means on said base for moving said cart about, means upstanding from said base and slidably supporting at least one drawer, said drawer having a pair of parallel side walls interconnected by a transverse front wall and having front-to-back divider means parallel to and spaced from said side walls and dividing said drawer into a plurality of storage areas and holding a plurality of patient cards and respective medicine cards, and holder means disposed on top of said divider means and having a plurality of recesses shaped and sized for respectively receiving disposable medication dispensing containers respectively having preselected medications therein, and a patient name card support adjacent each said recess for receipt of a patient name card with said patient name cards and medicine dispensing containers proximate to said patient cards and medicine cards in said storage areas, and means slidably mounting said holder means on said divider means for permitting slidable movement of said holder means forwardly of said drawer front wall.

2. A cart as set forth in claim 1 wherein there are a plurality of similar drawers disposed one above another.

3. A cart as set forth in claim 1 wherein said divider means comprises at least one wall, and further including an additional similar wall at one end of said drawer, and an additional, similar holder means slidably mounted on said additional wall.

4. A cart as set forth in claim 1 wherein said divider means comprises a plurality of dividers in each drawer, there being a holder means on each divider, and additional holder means, and means mounting said additional holder means adjacent one end of said drawer.

* * * * *